US005662448A

United States Patent [19]

Graushar et al.

[11] Patent Number: 5,662,448

[45] Date of Patent: Sep. 2, 1997

[54] METHOD AND APPARATUS FOR REGISTERING A COVER WITH A BOOK BLOCK

[75] Inventors: William T. Graushar, Wauwatosa; Calvin Lee Wade, Waukesha, both of Wis.

[73] Assignee: Quad/Tech, Inc., Sussex, Wis.

[21] Appl. No.: 526,752

[22] Filed: Sep. 11, 1995

[51] Int. Cl.[6] ..... B42C 11/02

[52] U.S. Cl. ..... 412/4; 412/5; 412/19

[58] Field of Search ..... 412/1, 4, 9, 11, 412/14, 5, 24; 271/227, 255

[56] References Cited

U.S. PATENT DOCUMENTS 4,657,239 4/1987 Ikesue et al. .

5,232,324 8/1993 Graushar .

FOREIGN PATENT DOCUMENTS

| | | | |
|---|---|---|---|
| 0130191 | 6/1991 | Japan | 412/14 |
| 1447705 | 12/1988 | U.S.S.R. | 412/14 |
| 2082506 | 3/1982 | United Kingdom | 412/14 |

*Primary Examiner*—Willmon Fridie, Jr.
*Attorney, Agent, or Firm*—Michael, Best & Friedrich

[57] ABSTRACT

An apparatus for registering a cover with a book block. The apparatus includes a book block holder, a cover feeder, and a lateral positioning device for laterally positioning a cover fed from the cover feeder. A cover position sensor positioned to detect a lateral position of the cover. A control mechanism is operatively interconnected with the cover position sensor. An adjusting device is provided for adjusting a relative lateral position between the lateral positioning device and the book block holder.

17 Claims, 3 Drawing Sheets

METHOD AND APPARATUS FOR REGISTERING A COVER WITH A BOOK BLOCK

FIELD OF THE INVENTION

The present invention generally relates to the field of print production, such as the production of printed products (e.g., magazines) having covers and signatures. More specifically, the present invention relates to methods and apparatuses for aligning a cover with a group of signatures (i.e., a "book block") to which the cover will be secured.

BACKGROUND OF THE INVENTION

In the production of magazines, a cover is typically secured to a book block after the signatures have been gathered. For example, the cover can be fed by a cover feeder and either stitched (e.g., stapled) to the book block on a saddle stitcher or glued to the book block on a perfect binder. In either situation, it is cosmetically important to align (i.e., "register") the center of the cover with the binding of the book block prior to the securing step. This is particularly true when the cover has a printed demarkation representing the binding of the magazine. For example, a perfect bound magazine may have the magazine title or the publication date printed on the binding. Without proper registration of the cover to the book block; the printed demarkation will not be positioned on the binding, thereby resulting in a defective product.

Traditionally, registration of the cover to the book block was performed manually by the operator of the binding machine. That is, the operator removed a bound magazine after the cover has been secured, and visually inspected the registration of the printed demarkation with the binding of the book block. If misregistration was detected, the cover feeder would be adjusted by manually moving guide rails in a lateral direction relative to the book block holder. After adjustment, another bound magazine was removed and inspected. This process continued until proper registration was achieved.

The traditional process has some disadvantages. First, since magazines that are removed from the process are difficult to reintroduce beck into the process, the removed magazines are typically discarded, resulting in wasted product, or repaired, resulting in decreased efficiency. In addition, if misregistration was substantial, all products having the misregistration must be discarded. Further, current production rates do not allow each cover to be manually inspected for registration, thereby potentially resulting in defective products being shipped. Also, since the inspection takes place after the cover has been attached to the book block, the resulting defective magazine must be discarded.

The above-noted problems are exacerbated when a cover wrap is applied to a magazine. A cover wrap is used to protect the exterior surface of a magazine cover. The cover wrap is applied to the outside surface of a cover prior to securing the cover to the book block. To inspect the resulting magazine for proper cover registration, the cover wrap must be removed from the cover. Such removal of the cover wrap results in a defective magazine that must be discarded, even if the cover is properly aligned.

SUMMARY OF THE INVENTION

Accordingly, it is an object of the present invention to provide an improved method and apparatus for registering a cover with a book block. The present invention does not require any part of the magazine to be removed from the process for inspection. In addition, the present invention is capable of inspecting cover registration for every cover, and therefore can make adjustments more quickly, resulting in fewer defective products. Further, the present invention inspects for cover registration before the cover is secured to the book block, thereby allowing registration to be adjusted before a defective product is produced. Also, the present invention can inspect cover registration even if there is a cover wrap secured to the cover, thereby avoiding the loss of potentially good products.

In one aspect, the present invention is embodied in an apparatus having a book block holder, a cover feeder, and a lateral positioning device (e.g., guide rails) for laterally positioning a cover fed from the cover feeder. A cover position sensor (e.g., an optical sensor) is positioned to detect a lateral position of the cover, and a control mechanism is operatively interconnected with the cover position sensor. An adjusting means (e.g., a linear actuator) is provided for adjusting a relative lateral position between the lateral positioning device and the book block holder.

Preferably, the position sensor is positioned adjacent an inside surface of a cover fed from the cover feeder. In this manner, the position sensor will detect the position of a marking on the inner surface of the cover. However, the position sensor could also detect the position of a marking on the outer surface of the cover. The control mechanism can include a comparator that compares a measured lateral position (e.g., provided by the position sensor) to a predetermined value. The adjusting means can include a linear actuator (e.g., a rotary motor driving a worm screw) operatively associated with the lateral positioning device. In addition, the linear actuator can be operatively interconnected with the control mechanism such that the control mechanism can automatically move the linear actuator.

In another aspect, the present invention is embodied in a method of registering a cover with a book block. The method is performed using an apparatus comprising a book block holder, a cover feeder, and a lateral positioning device. The method includes the steps of feeding the cover from the cover feeder toward the book block holder, determining a lateral position of the cover, comparing the lateral position to a predetermined value, changing a relative lateral position between the lateral positioning device and the book block holder, and engaging an inner surface of the cover with the book block.

The step of determining a lateral position can include the step of determining a lateral position of a marking on the cover. Preferably, the step of determining a lateral position comprises the step of imaging the inner surface of the cover. Alternatively, the step of determining a lateral position could include the step of imaging the outer surface of the cover. The step of changing a relative lateral position can include moving the lateral positioning device.

Another method embodying the present invention includes the steps of feeding the cover from the cover feeder toward the book block holder, determining a lateral position of a marking on an inner surface of the cover, comparing the lateral position to a predetermined value, changing a relative lateral position between the lateral positioning device and the book block holder, and engaging the inner surface of the cover with the book block.

DETAILED DESCRIPTION OF AN EMBODIMENT OF THE INVENTION

Figure 1:
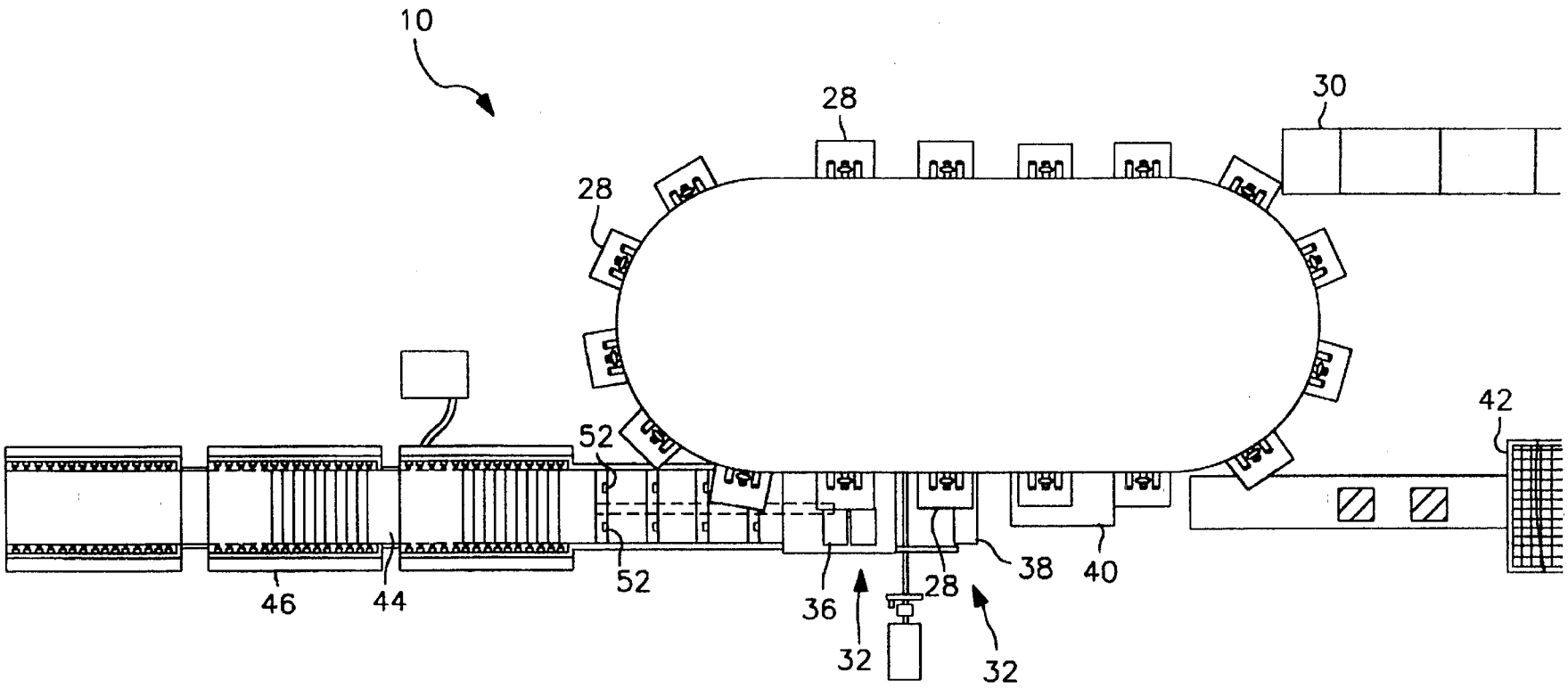
FIG. 1 is a top view of a perfect binder embodying the present invention.

An apparatus embodying the present invention is illustrated in FIGS. 1–5. The apparatus generally includes a perfect binder 10 for gluing a cover to a book block 12, a cover wrap feeder 14 for feeding cover wraps 16, a cover feeder 18 for depositing covers 20 onto the cover wraps 16, a lateral positioning device 22 for laterally positioning the cover and the cover wrap 16, an adjusting device 24 for adjusting the relative position between the lateral positioning device 22 and the binder, and a cover position sensor 26 for sensing the lateral position of the cover relative to the binder. Each of the above-noted components is operatively associated with the other components to provide an apparatus having the features of the present invention, as will be described below in more detail.

The perfect binder 10 includes a plurality of book clamps 28 that each receive a book block 12 from a gatherer 30 with the binding edge 34 of each book block 12 facing down. The binding edges 34 are trimmed and roughened, and the book blocks 12 are provided to a cover application area 32. In the cover application area 32, the binding edge 34 of each book block 12 is engaged with glue rollers 36 that apply glue (e.g., hot melt 34-1123 by National Starch and Chemical Company) to the binding edge 34. Subsequently, a cover is engaged with the binding edge 34 utilizing an applier drum 38, and the resulting magazine assembly is provided to a cover breaker 40. The magazine assembly is then provided to a trimmer 42 for trimming the edges of the magazine assembly to produce a completed magazine. Although the illustrated embodiment comprises a perfect binder 10, it should be appreciated that the broad concepts of the present invention could also be applied to other types of binders, such as saddle stitchers. Also, instead of an applier drum, other types of cover applicators could be used.

The cover wrap feeder 14 feeds cover wraps 16, one at a time, to a conveyor belt 44 that transports the cover wraps 16 to the cover application area 32. The cover wrap feeder 14 includes a storage bin 46 and a sucker feeder 48 for engaging a single cover wrap 16 and depositing the cover wrap 16 onto the conveyor belt 44. Any appropriate cover wrap feeder 14 could be used. In the illustrated embodiment, the cover wrap feeder 14 is part of a multiple cover deck, available from A. M. Sheridan. Alternatively, the cover wrap feeder could utilize a buffer instead of a storage bin.

A glue nozzle 50 applies a bead of releasable adhesive 55 to a center portion to the cover wraps 16, the center portion being aligned with the binding of the magazine. The releasable adhesive 55 is designed to create a tighter bend with the cover wrap 16 than with the cover so that the adhesive 55 will be pulled off of the cover when the cover wrap 16 is removed from the cover. In the illustrated embodiment, the adhesive 55 comprises a pressure sensitive adhesive available from the National Starch and Chemical Company under product numbers 70-3704 and 34-2602.

Figure 5:
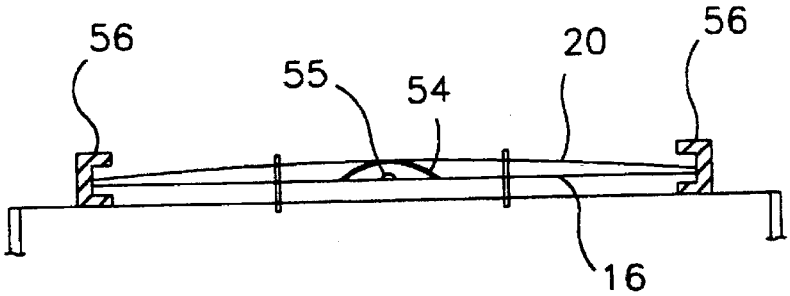
FIG. 5 is an enlarged section view taken along line 5—5 in FIG. 2.

The cover feeder 18 provides covers 20, one at a time, to the conveyor belt 44. Similar to the cover wrap feeder 14, the cover feeder 18 includes a storage bin 46 and a sucker feeder 48 that feeds individual covers 20 to the conveyor belt 44. The cover feeder 18 deposits a cover directly over a previously-deposited cover wrap 16. Both the cover and the cover wrap 16 are positioned into contact with registration lugs 52 on a conveyor belt 44. An elongated separator 54 (FIG. 5) is provided for preventing the cover from contacting the adhesive 55 on the cover wrap 16 until the cover and cover wrap 16 are properly registered with the registration lugs 52. The separator 54 extends from a position between the cover wrap feeder 14 and the cover feeder 18 to a position near the application area 32. The separator 54 includes an arcuate cross-section, as shown in FIG. 5, engageable with the bottom of cover 20 and the top of cover wrap 16. The cover and cover wrap 16 are then provided to the cover application area 32 where the cover and cover wrap 16 are engaged with a book block 12 by the applier drum 38. In the illustrated embodiment, the cover wrap feeder 14 and cover feeder 18 are part of a multiple cover deck sold by A. M. Sheridan.

The lateral positioning device 22 laterally positions the cover and cover wrap 16 relative to the book block 12. In the illustrated embodiment, the lateral positioning device 22 includes guide rails 56. The guide rails 56 are positioned adjacent to the cover application area 32 so that the cover and cover wrap 16 are laterally positioned immediately before being secured to the book block 12.

A device similar to the above-described assembly is disclosed in U.S. Pat. No. 5,232,324, which is incorporated herein by reference in its entirety.

The adjusting device 24 is designed to adjust the lateral position of the guide rails 56 relative to the book block 12 holder of the perfect binder 10. In the illustrated embodiment, the adjusting device 24 moves the guide rails 56. However it should be appreciated that the book block 12 holder could instead be moved. The illustrated adjusting device 24 comprises a linear actuator in the form of a worm screw 58 driven by a rotary motor 60. A handle 62 is provided to allow for manual rotation of the worm screw 58.

Figure 2:
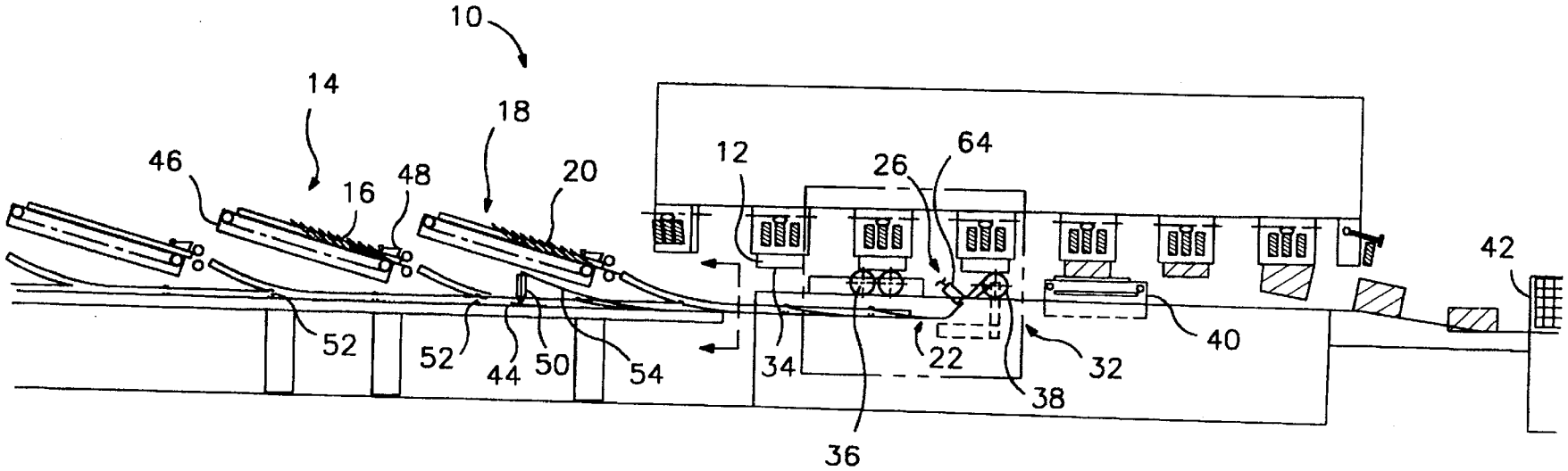
FIG. 2 is a side view of the perfect binder illustrated in FIG. 1.
Figure 3:
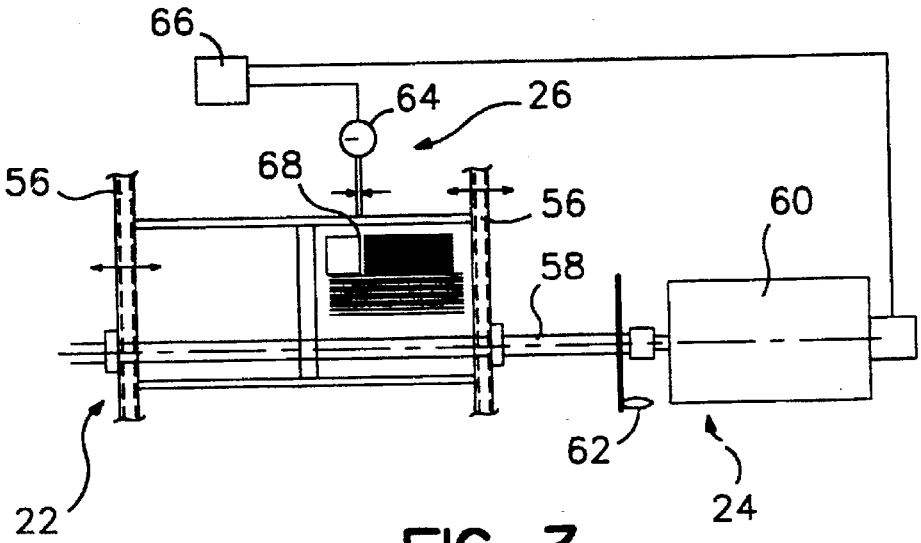
FIG. 3 is an enlarged view of the cover position sensor and adjusting device of the present invention.
Figure 4:
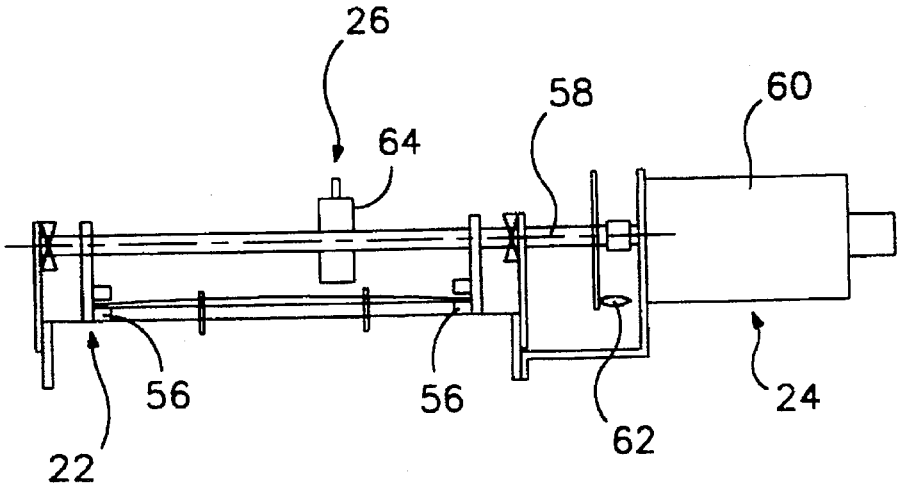
FIG. 4 is an enlarged section view taken along line 4—4 in FIG. 3.

In accordance with the present invention, the cover position sensor 26 is provided to detect the lateral position of the cover relative to the book block 12 holder. The illustrated position sensor 26 is positioned immediately in front of the applier drum 38. However, it should be appreciated that the position senor could instead be positioned at other locations, such as immediately after the cover feeder 18 or after the cover breaker 40. As seen in FIG. 2, the illustrated position sensor 26 is positioned to image the inner surface of the cover. It should be noted, however, that the position sensor could instead be positioned below the cover to image the outer surface of the cover. In the illustrated embodiment, the cover position sensor 26 comprises an optical sensor in the form of a video camera 64.

The image is provided to a control mechanism 66 (FIG. 3) that is preprogrammed to compare the image to a predetermined pattern. For example, the control mechanism 66 can be a microprocessor (e.g., a comparator) that digitizes the image and perform a pixel count to determine if the image matches up with, or falls within a predetermined tolerance of, a predetermined pattern. In one embodiment, the control mechanism 66 includes a contrast scanner that has the ability to recognize preprogrammed patterns of an image. In the illustrated embodiment, the predetermined marking comprises the vertical edge 68 of an illustration on the inside surface of the cover. When the particular marking is detected, the control mechanism 66 measures the lateral position of the marking on the image. The measured lateral position is compared to a predetermined value that corresponds with the lateral position of the marking when perfect registration of the cover to the book block 12 has occurred.

Such predetermined value can be established upon initial setup of the system. For example, the perfect binder 10 can be run and the resulting magazines can be manually inspected for cover registration. After proper registration has been achieved, the control mechanism 66 scans a cover as it is being provide to the cover application area 32. The scanned image is stored by the control mechanism, and is used as the basis for comparing subsequently scanned covers.

If an error between the measured position and the predetermined (i.e., stored) value is detected, the control mechanism 66 can activate the lateral positioning device 22 to move the guide rails 56 and compensate for the error accordingly. Alternatively, the control mechanism 66 could alert the operator of the error, and the operator could make the required adjustment manually. In any event, it is desireable to have a certain tolerance around the desired position within which no correction is required.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention. It is intended that the appended claims be construed to include alternative embodiments to the extent permitted by the prior art.

What is claimed is:

1. An apparatus for registering a cover with a book block, comprising:

a book block holder;

a cover feeder;

a lateral positioning device for laterally positioning a cover fed from said cover feeder;

a cover position sensor positioned to detect a lateral position of the cover;

a control mechanism operatively interconnected with said cover position sensor, said control mechanism including a comparator that compares a measured lateral position to a predetermined value; and adjusting means for adjusting a relative lateral position between said lateral positioning device and said book block holder.

2. An apparatus as claimed in claim 1, wherein said lateral positioning device comprises guide rails operatively positioned between said cover feeder and said book block holder.

3. An apparatus as claimed in claim 1, wherein said cover position sensor is positioned to detect a marking on an inner surface of said cover.

4. An apparatus as claimed in claim 1, wherein said cover position sensor comprises an optical sensor.

5. An apparatus as claimed in claim 4, wherein said optical sensor comprises a video camera.

6. An apparatus as claimed in claim 1, wherein said book block holder provides a book block into engagement with an inside surface of a cover fed from said cover feeder, and wherein said position sensor is positioned adjacent an inside surface of a cover fed from said cover feeder.

7. An apparatus as claimed in claim 1, wherein said adjusting means comprises a linear actuator operatively associated with said lateral positioning device.

8. An apparatus as claimed in claim 7, wherein said linear actuator comprises a worm screw coupled to a rotary motor.

9. An apparatus as claimed in claim 7, wherein said linear actuator is operatively interconnected with said control mechanism.

10. An apparatus as claimed in claim 1, further comprising a cover wrap feeder positioned to feed cover wraps toward said book block holder.

11. A method of registering a cover with a book block using an apparatus comprising a book block holder, a cover feeder, and a lateral positioning device, said method comprising the steps of:

feeding the cover from the cover feeder toward the book block holder;

determining a lateral position of the cover;

comparing the lateral position to a predetermined value;

changing a relative lateral position between the lateral positioning device and the book block holder, said changing step including the step of laterally moving the lateral positioning device relative to the book block holder; and engaging an inner surface of the cover with the book block.

12. A method as claimed in claim 11, wherein said step of determining a lateral position comprises the step of determining a lateral position of a marking on the cover.

13. A method as claimed in claim 11, wherein said step of determining a lateral position comprises the step of imaging the inner surface of the cover.

14. A method as claimed in claim 11, wherein said lateral positioning device comprises at least one guide rail, and wherein said step of moving the lateral positioning device comprises the step of moving the guide rail.

15. A method as claimed in claim 11, further comprising the step of feeding a cover wrap from a cover wrap feeder.

16. An apparatus for registering a cover with a book block, comprising:

a book block holder;

a cover feeder;

a lateral positioning device for laterally positioning a cover fed from said cover feeder;

a cover position sensor positioned to detect a lateral position of a marking on the cover;

a control mechanism operatively interconnected with said cover position sensor; and adjusting means for adjusting a relative lateral position between said lateral positioning device and said book block holder.

17. A method of registering a cover with a book block using an apparatus comprising a book block holder, a cover feeder, and a lateral positioning device, said method comprising the steps of:

feeding the cover from the cover feeder toward the book block holder;

determining a lateral position of a marking on the cover;

comparing the lateral position to a predetermined value;

changing a relative lateral position between the lateral positioning device and the book block holder; and engaging an inner surface of the cover with the book block.

* * * * *